US007391387B2

(12) United States Patent
Murray et al.

(10) Patent No.: US 7,391,387 B2
(45) **Date of Patent: *Jun. 24, 2008**

(54) MULTI PIECE PUZZLE-LOCK ANTENNA USING FLEX FILM RADIATOR

(75) Inventors: Thomas Murray, Lincoln, NE (US); Ying Dong Song, Lincoln, NE (US); Cheryl A. Mayer, Lincoln, NE (US); Brian T. Potter, Lincoln, NE (US)

(73) Assignee: Centurion Wireless Technologies, Inc., Lincoln, NE (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/358,230

(22) Filed: Feb. 21, 2006

(65) Prior Publication Data

US 2006/0139221 A1 Jun. 29, 2006

Related U.S. Application Data

(63) Continuation of application No. 10/939,738, filed on Sep. 13, 2004, now Pat. No. 7,081,855.

(60) Provisional application No. 60/502,507, filed on Sep. 12, 2003.

(51) Int. Cl.
*H01Q 1/36* (2006.01)

(52) U.S. Cl. ..... 343/895

(58) Field of Classification Search ..... 343/702, 343/895, 875, 700 MS
See application file for complete search history.

(56) References Cited

U.S. PATENT DOCUMENTS

| | | | | |
|---|---|---|---|---|
| 6,292,151 | B1 * | 9/2001 | Wu | 343/721 |
| 6,369,777 | B1 | 4/2002 | Ohara et al. | 343/895 |
| 6,480,173 | B1 | 11/2002 | Marino | 343/895 |
| 6,525,692 | B2 * | 2/2003 | Kim et al. | 343/702 |
| 6,661,391 | B2 * | 12/2003 | Ohara et al. | 343/895 |
| 6,911,940 | B2 | 6/2005 | Poilasne et al. | 343/700 MS |
| 7,081,855 | B2 * | 7/2006 | Murray et al. | 343/702 |

FOREIGN PATENT DOCUMENTS

JP 58-64803 4/1983

OTHER PUBLICATIONS

International Searching Authority, Notification of Transmittal of the International Search Report or the Declaration, Feb. 18, 2005.
International Searching Authority, "Written Opinion of the International Searching Authority" Feb. 18, 2005.

* cited by examiner

*Primary Examiner*—Douglas W. Owens
*Assistant Examiner*—Minh Dieu A
(74) *Attorney, Agent, or Firm*—Holland & Hart LLP

(57) ABSTRACT

The present invention provides a flexible film antenna. The flexible film antenna includes a radiating element comprising a conductive trace on a flexible film. Flexible film is mounted on a core. The core comprises at least two parts that are releasably coupled together in snap or sliding relation. A feed post extends out a base of the core to connect to a power feed. Finally, a protective housing can be molded over the antenna.

10 Claims, 4 Drawing Sheets

MULTI PIECE PUZZLE-LOCK ANTENNA USING FLEX FILM RADIATOR

This application claims the benefit of U.S. Provisional Patent Application Ser. No. 60/502,507, titled the same, filed Sep. 12, 2003 and incorporated herein by reference.

FIELD OF THE INVENTION

The present invention relates to antennas and, more particularly, to overmolded antenna systems.

BACKGROUND OF THE INVENTION

Cellular telephone, PDA, and other wireless devices send and receive data using radio frequency ("RF") transmissions. The RF transmissions are sent and received through an antenna. One currently useful antennal is a flex film antenna, which are commonly used in the art.

Conventionally, flex film antennas are constructed using one of two ways. The first methodology involves a snap together antenna. The second methodology involves an overmolded single core. Neither of these designs is satisfactory. Using these designs, the following and other problems still exist with flex film antennas:

- A single piece core component is required in existing simplified overmolded flex film antenna designs to facilitate the plastic molding process. This design excludes the internal volume of core component as a possible location for the flex film radiator element.
- Existing overmolded flex film antenna radiators antenna systems have a limited usable radiator surface typically limited to the radial surface area of the single piece core component.
- The electrical connection of the flex film to the metallic threaded connector (radio interface) on existing designs use solder or axial compression. Soldering is expensive and introduces variation in the amount of solder deposited, thus variation in antenna performance from antenna to antenna. Axial compression interface (used on "snap together" designs) relies on a component of the antenna to apply compressive load to the flex film. This component is typically the outer sheath that is susceptible to the external environment and possible damage from drop. Additionally the sheath is typically a polymer which overtime will lose its material properties as it is under constant tensile load in these designs. As the sheath weakens, the compressive load diminishes thus increasing the likelihood of intermittent flex film to metallic connector electrical connection.
- Flex film tears easily when a load is applied to the material. A unique assembly interface is needed to accomplish a consistent interface and a manufacturable design.

Thus, it would be desirous to develop a flex film antenna that addressed these and other problems.

SUMMARY OF THE INVENTION

The present invention provides a flexible film antenna. The flexible film antenna includes a radiating element comprising a conductive trace on a flexible film. The flexible film is mounted on a core. The core comprises at least two parts that are releasably coupled together in snap or sliding relation. A feed post extends out a base of the core to connect to a power feed. Finally, a protective housing can be molded over the antenna.

The foregoing and other features, utilities and advantages of the invention will be apparent from the following more particular description of a preferred embodiment of the invention as illustrated in the accompanying drawings.

BRIEF DESCRIPTION OF THE DRAWING

The accompanying drawings, which are incorporated in and constitute a part of this specification, illustrate embodiments of the present invention, and together with the description, serve to explain the principles thereof. Like items in the drawings are referred to using the same numerical reference.

DETAILED DESCRIPTION

Figure 1:
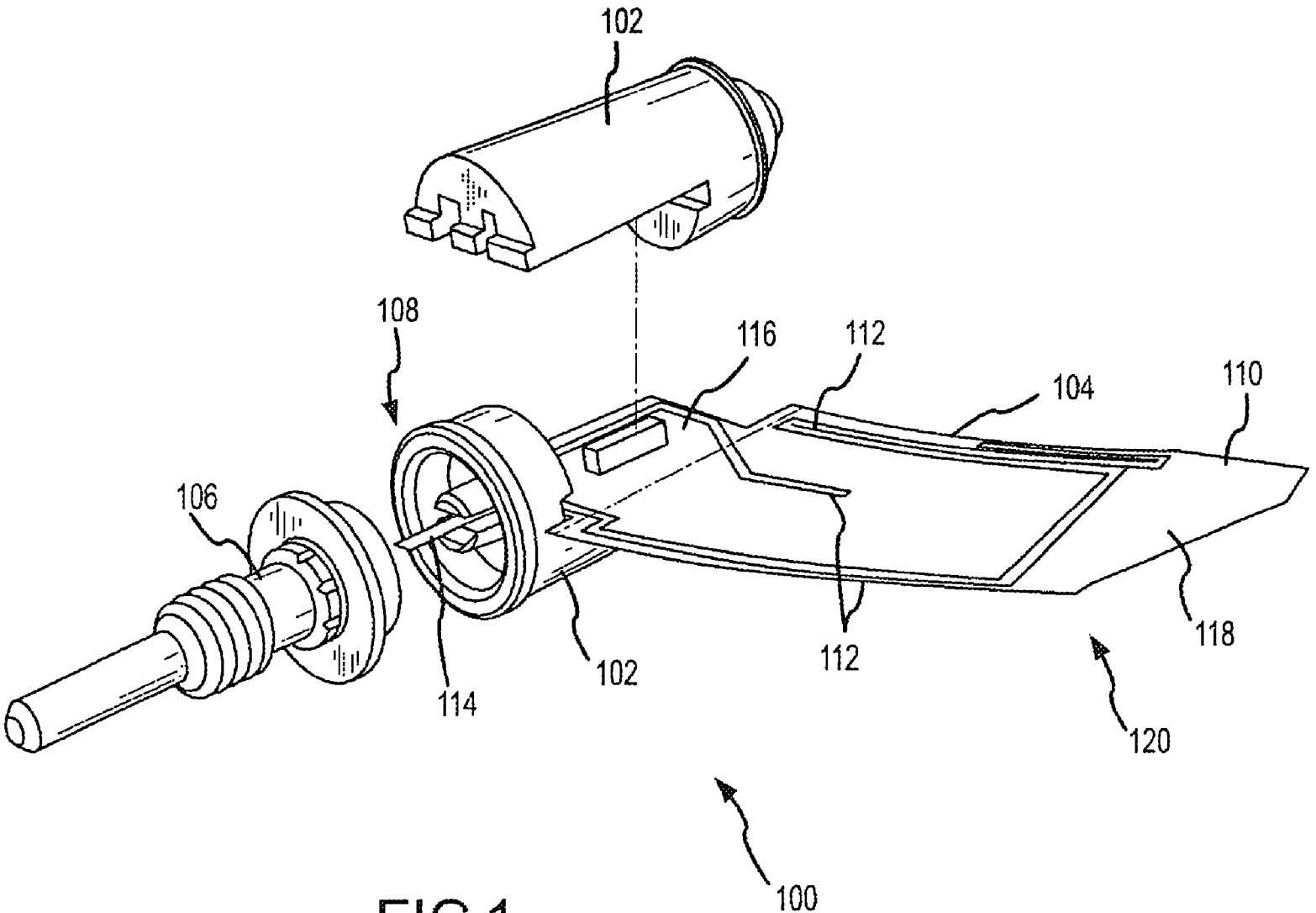
FIG. 1 is a partially exploded, perspective view of an antenna comprising an embodiment of the present invention without the housing.

The present invention will be further explained with reference to the FIGS. 1-4. In particular, FIGS. 1-4 show an overmolded antenna with a multi piece core assembly and flex film radiating element consistent with an embodiment of the invention. The multi piece core increases the usable surface area for the radiating flex film element. This is accomplished by "threading" the flex film in between the core pieces, thus using the internal volume region of the core system. (FIG. 1). The actual placement of the flex film radiation element within the internal volume is dependent, in part, on design choice and, in part, on functional requirements of the antenna.

FIG. 1 shows portions of an antenna 100. Antenna 100 comprises a core 102 or support structure on which a flexible film 104 is wound. A power feed element 106 connects to a base 108 of antenna 100.

Flexible film 104 comprises a non-conductive material 110, typically a flexible plastic, rubber, or the like, with one or more conductive traces 112, such as copper or the like, on the non-conductive material 110. The size, shape, dielectric constant, etc. of the non-conductive material and the size, shape, and placement of the conductive trace(s) 112 are largely a matter of design choice and radiating characteristics of antenna 100. Flexible film 104 comprises a power connection 114. Power connection 114 comprises a portion of non-conductive material 106 and conductive trace 108 operatively coupled to power feed element 106, as will be explained further below. Power connection 114 is shown with a single power feed, but multiple power feeds could be used instead of the single feed line as shown. Further, conductive traces 112 shown could be a single trace or multiple traces as shown.

Figure 2:
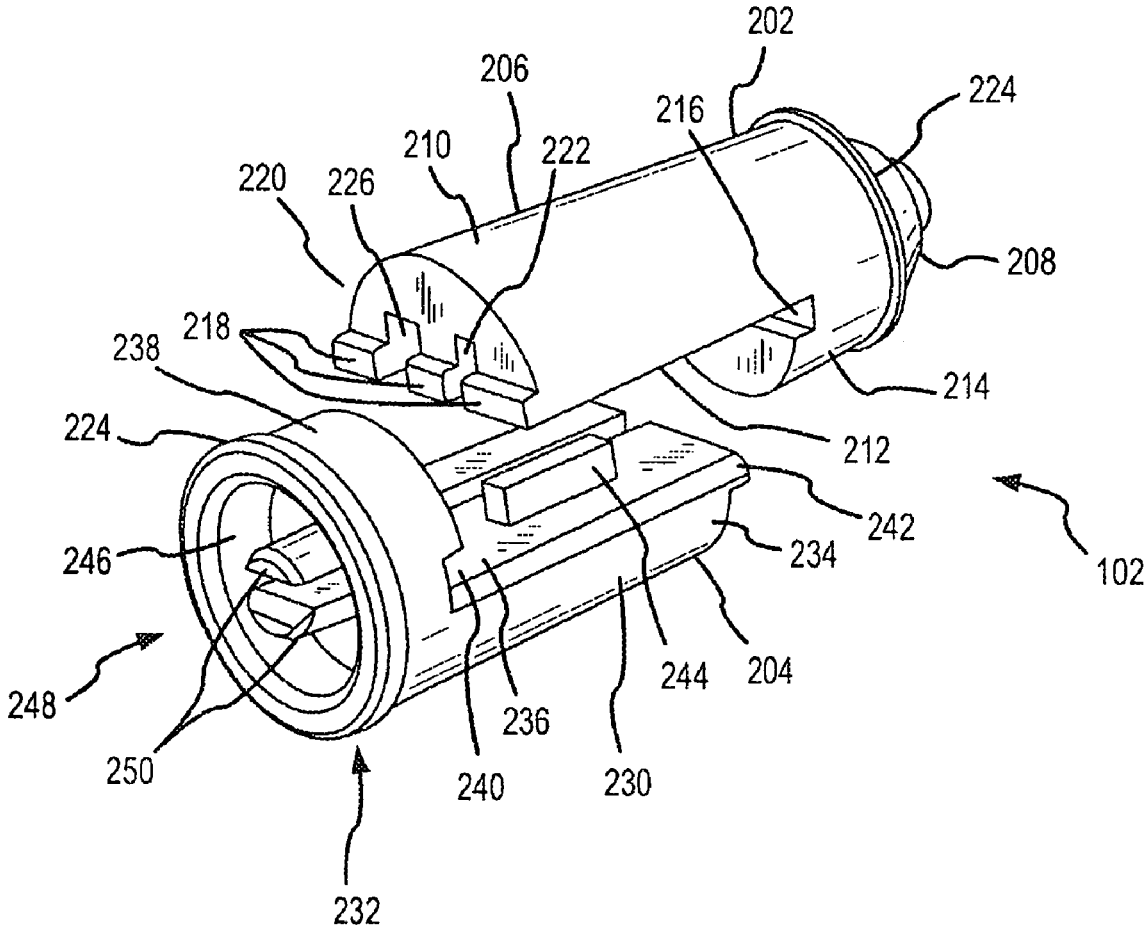
FIG. 2 is a partially exploded, perspective view of the core of FIG. 1 comprising an embodiment of the present invention without the housing.

Referring now to FIG. 2, core 102 is shown in more detail. Core 102 comprises at least two releasably coupled parts, upper part 202 and lower part 204. Upper and lower are relative terms and used only in connection with FIG. 2 for reference. Upper and lower should not be considered limiting.

Upper part 202 has an upper support section 206 and a top portion 208. Upper support section 206 comprises a half cylinder with a convexly shaped outer surface 210 and a substantially flat lower part interface 212. Top portion 208 comprises a full cylinder with a convexly shaped outer surface 214. Top portion 208 has at least one upper recess 216 extending below a plane defined by lower part interface 212.

Upper support section 206 has at least one upper protrusion 218 extending from an upper part base 220, which is opposite top portion 208. The at least one upper protrusion 218 resides just above lower part interface 212. At least one alignment recess 222 extends along a length lower part interface 212. Upper part 202 may have one or more relief troughs 226 as necessary. Top portion 208 has a guide ridge 224 extending about outer surface 214. Upper part 202 is described with several components, however, one of ordinary skill in the art on reading the disclosure will now understand that upper part could be a single molded piece of plastic or multiple pieces of molded plastic coupled together.

Lower part 204 has a lower support section 230 and a bottom portion 232. Lower support section 230 comprises a half cylinder with a convexly shaped outer surface 234 and a substantially flat upper part interface 236. Bottom portion 232 comprises a fully cylinder with a convexly shaped outer surface 238. Bottom portion 232 comprises at least one lower recess 240 above upper part interface 236 that is shaped to slidably couple to the at least one upper protrusion 218. Lower support section 230 comprises at least one lower protrusion 242 below upper part interface 236 that is shaped to slidably couple the at least one upper recess 216. An alignment tab 244 resides on upper part interface 236 and is shaped to slidably couple to alignment recess 222. Alignment tab 244 also engages an alignment cutout 116 (See FIG. 1) in the flexible film to assist in aligning the flexible film 104 on core 102.

Bottom portion 232 has a guide ridge 224, a power feed recess 246, a power connection slot 248, and at least one power feed support post 250. Power feed support post 250 is shown as two power feed support posts 250 or tabs extending into power feed recess 246. It has been found using two separated power feed support posts 250 inhibits tearing of flexible film 104, which can cause a power failure or disconnect. Power connection slot 248 could form a through hole or bore in the at least one power feed support post 250 if desired.

As shown, core 102 has a generally cylindrical shape that converges from bottom portion 232 to top portion 208. The shape of core 102 could be as shown, a straight cylinder, a cubic shape, a conical shape, or other polygonal shapes as a matter of design choice. However, to the extent core 102 has edges, the edges should be beveled or chamfered to reduce damage to flexible film 104.

Referring back to FIG. 1, flexible film 104 and core 102 may be assembled by inserting power connection 114 through power connection slot 248 such that power connection 114 extends from bottom portion 232. Further cutout 116 would be aligned with alignment tab 244 such that flexible film 104 resides one upper part interface 236 and extend beyond outer surface 234. Upper part 202 would be arranged such that alignment tab 244 aligns with alignment recess 222. Upper part 202 would be pushed down on lower part 204 until lower part interface 212 substantially abutted flexible film 104. Upper part 202 would than be slidably moved along lower part 204 until at least one upper protrusion 218 and at least one lower recess 240, and at least one lower protrusion 242 and at least one upper recess 216 slidably engaged forming a puzzle lock arrangement.

Flexible film 104 would than be wrapped or threaded around outer surfaces 210, 214, 234, and 238. Flexible film 104 further comprises an adhesive 118 such that when flexible film 104 is completely wrapped or threaded around core 102, adhesive 118 would couple flexible film 104 to itself or one of outer surfaces 210, 214, 234, and 238 to inhibit unraveling of flexible film 104.

Figure 3:
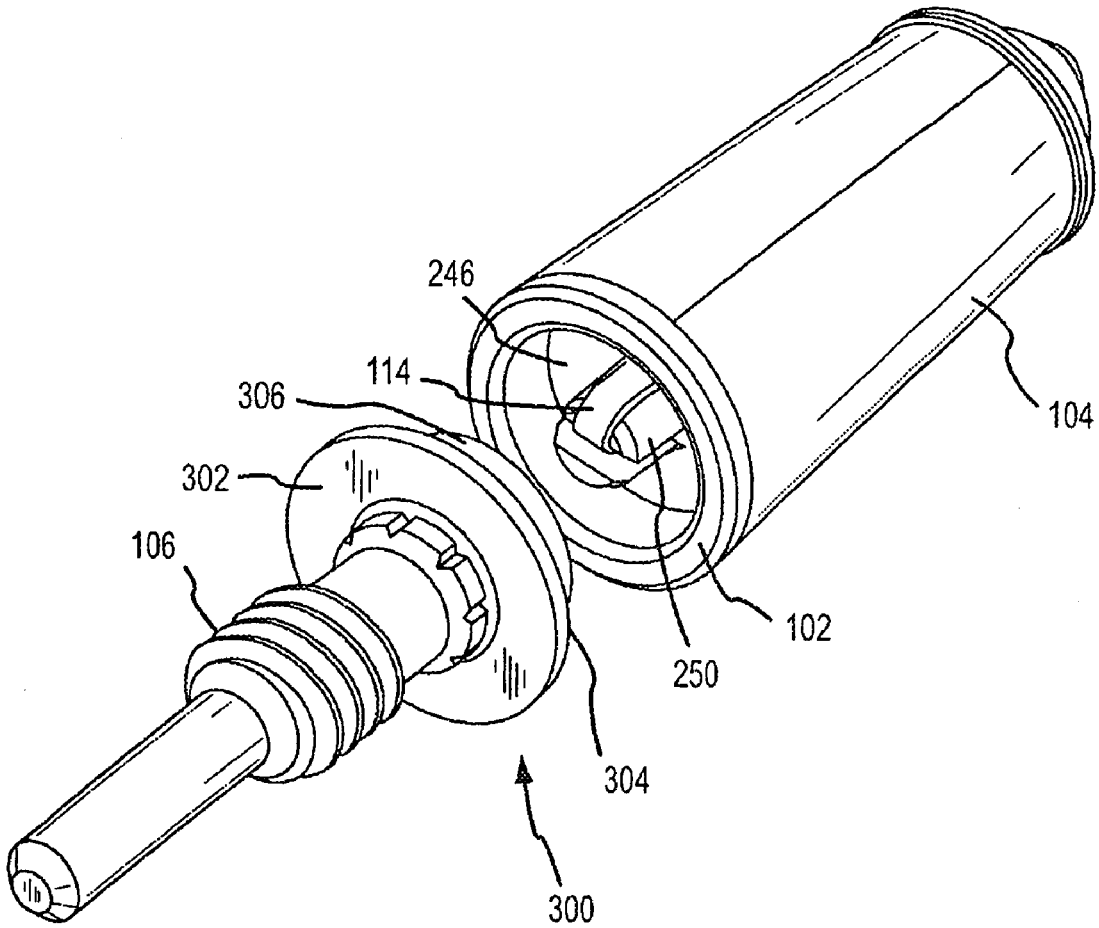
FIG. 3 is a partially exploded, perspective view of the base of the antenna of FIG. 1.
Figure 4:
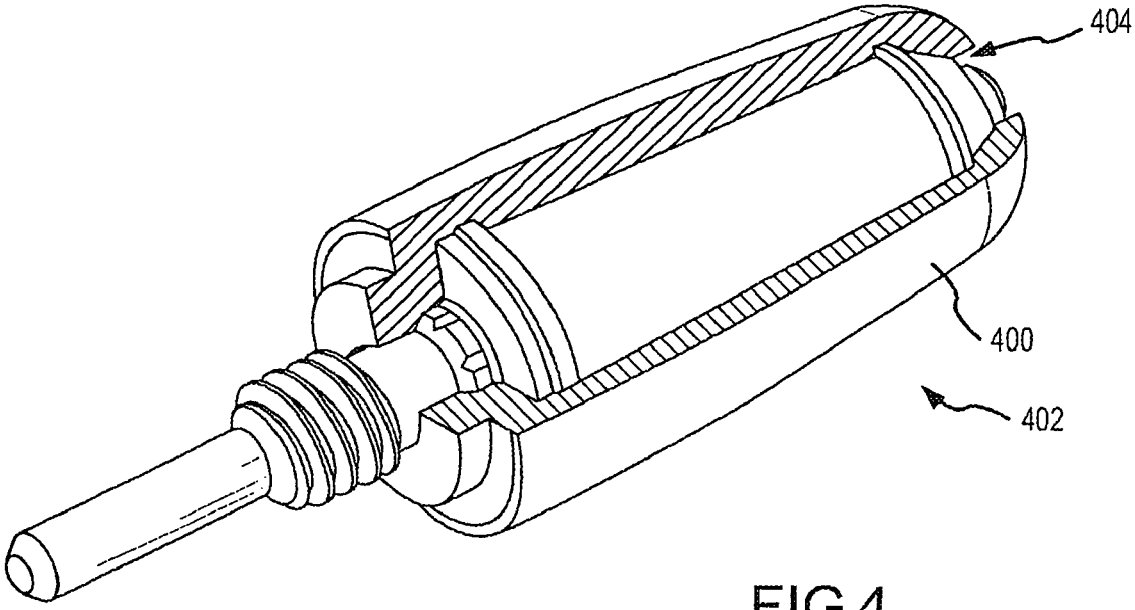
FIG. 4 is a cutaway of the antenna of FIG. 1.
Figure 5:
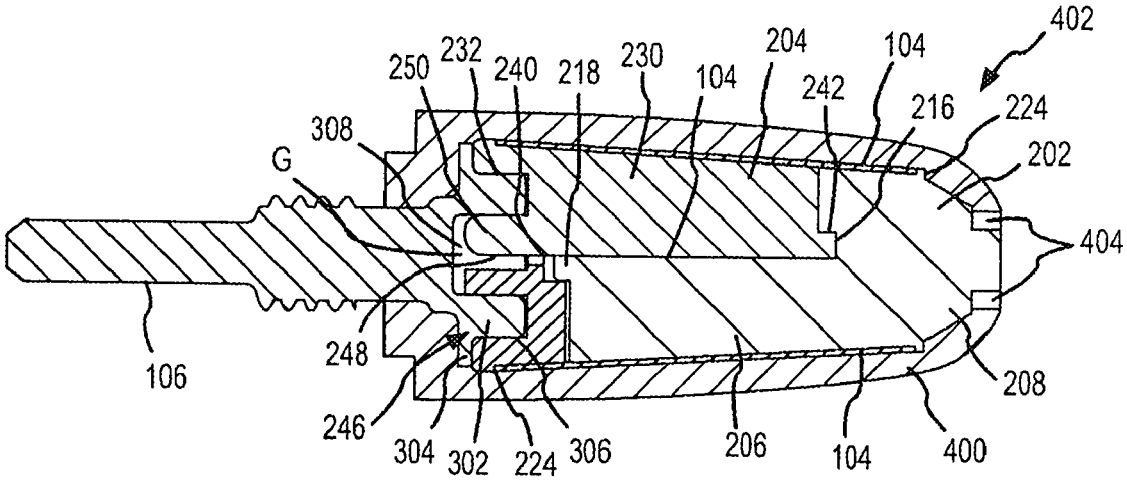
FIG. 5 is a cross-sectional view of the antenna of FIG. 4.

Referring to FIGS. 3 and 5, power feed element 106 is described in more detail. Power feed element 106 comprises a plug portion 300 that fits into power feed recess 246. Plug portion 300 comprises a base 302 having an annular ledge 304, which could be contiguous as shown or at least one tab, on which bottom portion 232 resides. Extending into power feed recess 246 is an outer plug surface 306. Outer plug surface 306 defines an inner plug recess 308. Inner plug recess 308 is shaped to cooperatively engage at least one power feed support post 250. Power feed support post 250 may not extend fully into inner plug recess 308, which may leave a small gap G.

Generally, core 102 is formed from non-conductive plastic. Power feed element 106 is formed from conductive metal. Referring specifically to FIG. 3, power connection 114 is bent over the at least one power feed support post 250. Power feed element 106 is plugged into power feed recess 246 such that outer plug surface 306 plugs into power feed recess 246 and the at least one power feed support post 250 snuggly fits (i.e., plugs) into inner plug recess 308 such that the conductive trace 112 on power connection 114 engages metal plug portion 300 forming a radial power feed connection. Forming core 102 of plastic and power feed element 106 from metal reduces failures do to plastic fatigue.

Once power feed element 106 is plugged into power feed recess 246, a housing 400 may be applied around core 102 forming antenna 100. Optionally, housing 400 can be formed by injection molding housing 400 around the device by placing power feed element 106 in a recess in a mold. The device is stabilized by connecting a portion of the top portion 208 to prongs, which may result in an annular void 402 at the peak 404 of housing 400.

Guide ridges 224 are useful in aligning flexible film 104 about core 102, but also serve to inhibit flexible film 104 from peeling or unraveling from core 102 when housing 400 is molded about core 102. Further, a portion 120 of flexible film 104 may be cut to remove edges that the molding may cause to peel, unravel, or tear.

While the invention has been particularly shown and described with reference to an embodiment thereof, it will be understood by those skilled in the art that various other changes in the form and details may be made without departing from the spirit and scope of the invention.

We claim:

1. A flexible film antenna, comprising:

a flexible substrate with at least one conductive trace on the flexible substrate, a portion of the at least one conductive trace comprising at least one power connection point;

a core, the core comprising at least an upper part releasably coupled to a lower part;

the lower part having a bottom portion allowing a power source to connect to the power connection point;

the flexible substrate residing in part between the upper part and the lower part with a remainder of the flexible substrate being mounted on an outer surface of the core, and the at least one conductive trace residing at least in part on an interface between the upper part and the lower part.

2. The flexible film antenna according to claim 1, wherein the upper part and the lower part are slidably coupled.

3. The flexible film antenna according to claim 1, wherein the upper part and the lower part are snap coupled.

4. The flexible film antenna according to claim 1, wherein bottom portion includes a slot and the power source is connected to the power connection point via the slot.

5. The flexible film antenna according to claim 4, wherein the at least one conductive trace and flexible substrate extend through the slot and connect to the power source.

6. The flexible film antenna according to claim 5, wherein further comprising at least one support post coupled to the bottom about the slot to provide support for the at least one conductive trace and flexible substrate extending through the slot.

7. The flexible film antenna according to claim 4, wherein a power trace extends from the power source through the slot and connects to the power connection point.

8. The flexible film antenna according to claim 1, further comprising at least one alignment tab and corresponding alignment cutout to facilitate the coupling the upper part and the lower part.

9. The flexible film antenna according to claims 1, further comprising a housing substantially surrounding the core.

10. The flexible film antenna according to claim 9, wherein the housing is overmolded on the core.

* * * * *